United States Patent [19]

Warren

[11] 4,270,795

[45] Jun. 2, 1981

[54] FOLDING CHAIR

[76] Inventor: Joseph V. Warren, 517 15th St., Huntington Beach, Calif. 92648

[21] Appl. No.: 968,977

[22] Filed: Dec. 13, 1978

[51] Int. Cl.[3] ..... A47C 4/28

[52] U.S. Cl. ..... 297/45; 403/59

[58] Field of Search ..... 297/45; 52/738; 403/59, 403/80, 79, 385, 388

[56] References Cited

U.S. PATENT DOCUMENTS

| | | | |
|---|---|---|---|
| 610,101 | 8/1898 | Sullivan | 403/59 |
| 723,610 | 3/1903 | Kohler | 403/59 |
| 1,064,145 | 6/1913 | Jacobs | 403/59 |
| 1,856,759 | 5/1932 | Grondin | 297/45 |
| 2,713,385 | 7/1955 | McQuilkin | 297/45 |
| 3,866,364 | 2/1975 | Pollard | 52/738 |

FOREIGN PATENT DOCUMENTS

| | | | |
|---|---|---|---|
| 92471 | 5/1923 | Austria | 297/45 |
| 96705 | 12/1923 | Austria | 297/45 |
| 1070000 | 7/1954 | France | 297/45 |
| 1073121 | 9/1954 | France | 297/45 |
| 1421568 | 11/1965 | France | 403/59 |
| 640821 | 7/1950 | United Kingdom | 297/45 |

*Primary Examiner*—Roy D. Frazier
*Assistant Examiner*—Peter A. Aschenbrenner

[57] ABSTRACT

A chair having two rectangular side members with grooves therein, a folding seat the opposite sides of which slide vertically in said grooves, pivoting cross member supports for the seat, the upper ends of each carrying opposite sides of the seat and the lower ends of each being pivotably affixed to the side members, a folding back, and means pivotably connecting opposing upper extremities of the back to opposite side members and removably positioning the lower opposite extremities of the back at an angle to the vertical whereby the entire chair may be folded to a width approximating the sum of the least dimensions of the two side members.

8 Claims, 10 Drawing Figures

FOLDING CHAIR

BACKGROUND OF THE INVENTION

The background of the invention will be discussed in two parts:

Field of the Invention

This invention relates to chairs and more particularly to folding chairs of a particularly unique and aesthetically appealing configuration.

Description of the Prior Art

Folding chairs of various types have become increasingly common. However, most of these chairs are not sufficiently aesthetically pleasing. Such chairs usually look like folding chairs; they are ungainly and convey a temporary feeling when unfolded while they offer projecting legs and open holes of unpleasing shapes and are awkward to store when folded. Most prior art folding chairs are not easily stacked because of their configurations. Folding chairs, in general, are used for temporary purposes and are not designed to match other furniture. They are, in general, less sturdy and durable than most furniture.

The construction of prior art folding chairs is usually quite complicated making such chairs difficult and expensive to assemble.

Attempts to solve these problems have been relatively unsuccessful because the requirement that a chair fold places constraints upon its design which gives rise to the problems.

It is an object of the present invention to provide a new and aesthetically-pleasing folding chair.

It is another object of the present invention to provide folding chairs which fold easily into a small space, are portable, and do not interfere with one another in storage.

It is a further object of this invention to provide folding chairs which may be made to match other furniture and elements of their environment.

Yet another object of this invention is to provide an especially strong and durable, yet comfortable, folding chair.

An additional object of this invention is to provide a folding chair of simple design which is quite easy to assemble.

SUMMARY OF THE INVENTION

The foregoing and other objects of the invention are accomplished in the present invention by a folding chair which has two rectangularly-shaped opposing side members. Each of the side members is formed of four elongated members which may be metallic extrusions, identical in cross section, which abut at forty-five degree angles and are fastened together to form a rectangular frame surrounding and holding a rectangular side piece. The side piece provides superior strength and a surface for various designs. Each of the elongated members is provided with a cover which snaps into place to hide various construction details and to protect the members from wear. The opposing rectangular side members support a folding seat and a folding back. The folding seat is slideably secured to a groove in opposing ones of the vertical elongated member of each side member. A pair of pivoting cross-members are connected in front and back of the seat and to the base of the rectangular side members. The folding back is pivotably secured to the opposing side members at the upper horizontal elongated members and is removably secured on opposite sides of its lower extremities to the folding seat.

The construction is such that by unfastening the folding back from the folding seat and by pressing on the two side members the chair is caused to collapse into a box-like configuration having a volume essentially equal to the combined dimension of the two side members. The folded chair is very thin and, thus, may be easily stacked and stored without the problems of many prior art folding chairs. Holes cut from each of the rectangular side members provide convenient handles for carrying the chair much like a briefcase.

The other objects, features, and advantages of the invention will become apparent from a reading of the specification when taken in conjunction with the drawings in which like reference numerals refer to like elements in the several views.

DESCRIPTION OF THE PREFERRED EMBODIMENT

Figure 1:
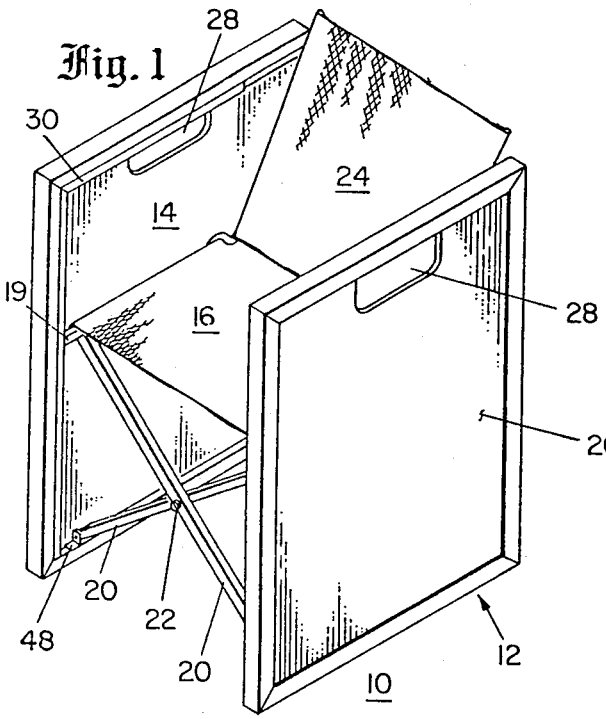
FIG. 1 is a perspective view of a folding chair constructed in accordance with the invention.
Figure 2:
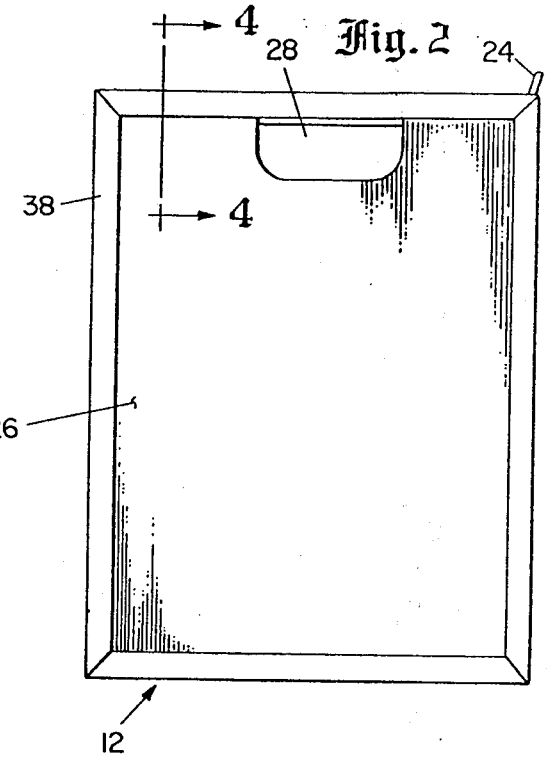
FIG. 2 is a side view of the folding chair shown in FIG. 1.
Figure 3:
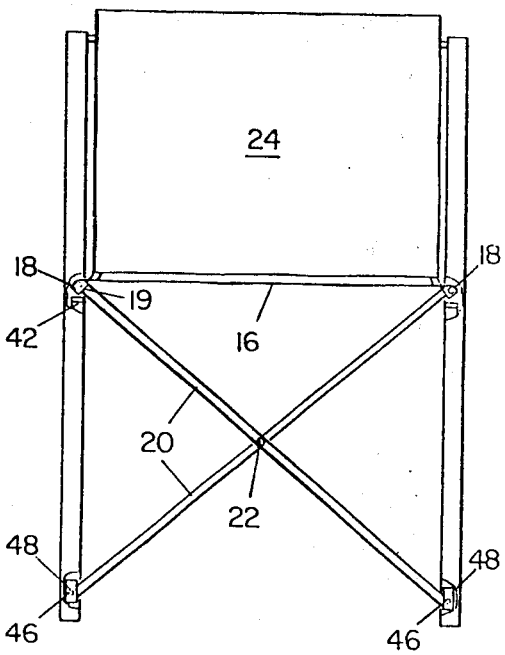
FIG. 3 is a front view of the folding chair shown in FIG. 1.

Referring now to the drawings and particularly to FIGS. 1, 2 and 3, there is shown a chair generally designated 10 having two rectangular side members designated 12 and 14. The side members 12 and 14 support a collapsible seat 16 supported at opposite sides by bars 18. Bars 18 are each supported by an elongated member 19 which is open on one side and is connected to cross members 20 which are pivotally secured at their midpoints 22 to one another and are pivotably connected at their lower ends to sides 12 and 14.

A folding back 24 is pivotably connected at its upper extremities to each of sides 12 and 14. The back 24 is also removably secured to the seat 16 at a conveniently inclined resting angle. Both the seat 16 and the back 24 may be made of a fabric such as nylon or an equivalent sewed at the sides and ends in a well-known manner.

As will be seen in FIGS. 1 and 2, each of the sides 12 and 14 has a large rectangular side panel 26 upon which may be placed graphics generally suited to the surroundings in which the chair is to be used. The rectangular side panels 26 each have an opening 28 cut therein which forms a convenient carrying handle when the chair is collapsed. The side panels 26 may preferably be constructed of a plastic material, fiberboard, or some other thin rigid material which is generally light in weight but provides substantial strength in compression thereby offering substantial rigidity to the chair in the open position.

Figure 4:
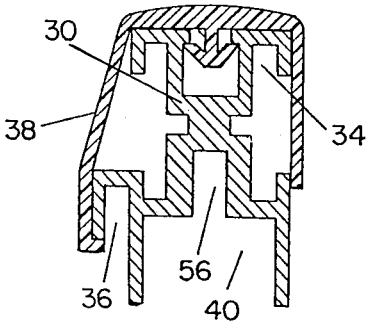
FIG. 4 is a cross sectional view of an elongated member used to form the side members of the folding chair of FIG. 1 and of the covers for such elongated member, the cross section being taken generally along line 1—1 of FIG. 2.
Figure 5:
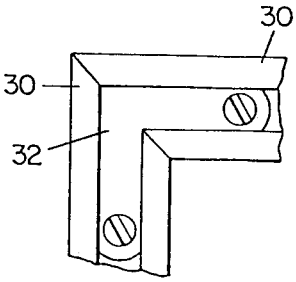
FIG. 5 is an enlarged view of a corner of the side member shown in FIG. 2 demonstrating the method by which the elongated members may be connected together.

The side panels 26 of the sides 12 and 14 are supported by elongated members 30 shown in cross section in FIG. 4 (taken along section line 4—4 of FIG. 2). Each of the elongated members 30 (which may, for example, be extrusions manufactured in a well known manner from a material such as aluminum) may be cut at a 45° angle as shown in FIG. 5. A right angle bracket 32 inserted in the channel 34 of each member 30 and secured thereto such as by screws or rivets connects the adjoining members 30 to one another. The members 30 so connected form a rectangle surrounding the side panel 26 which rests and is secured in a channel 36 of each member 30, thereby lending affirmative strength to resist bending of the member 30 and distortion of the corners of the rectangle. A flexible cover 38 which may be made of a flexible plastic such as styrene is cut in a length to fit over and cover the members 30 thereby enclosing the brackets 32 and other fittings. The flexible cover 38 provides protection for the chair in the stacked or open conditions, for one sitting in the chair, and for the floor upon which the chair sits.

Figure 6:
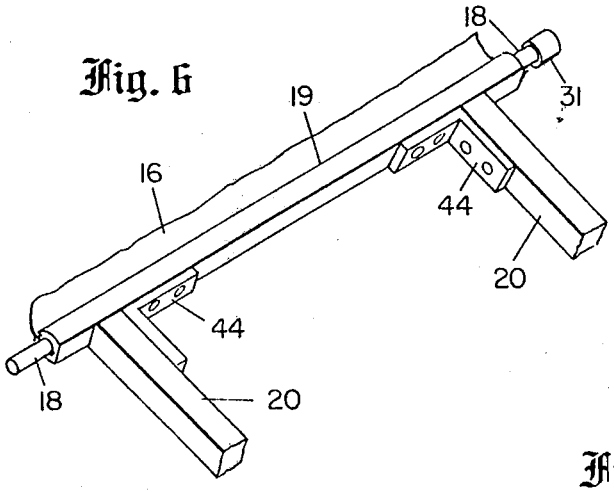
FIG. 6 is a perspective view showing the details of the connection of the folding seat to the cross members which support the folding seat.

The bars 18 which hold the folding seat 16 slide vertically in a channel 40 (see FIG. 4) in each of the vertical ones of the members 30. In one exemplary embodiment, the ends of bars 18 are fitted with protective plastic covers 31 (see FIG. 6). A stop 42 is positioned in and secured to each of the vertical members 30 within channel 40 at a position to maintain the folding seat 16 at an appropriate height in the open position.

Figure 9:
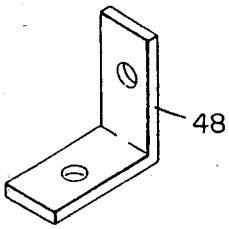
FIG. 9 is a perspective view of a bracket used in the folding chair shown in FIG. 1.

The cross members 20 are secured to the members 19 in an appropriate manner such as by riveted bracket 44. In the embodiment shown in FIG. 6, the seat 16 is looped about the bar 18 which is held within the member 19 thereby securing the seat 16 to the cross members 20. The cross members 20 are secured to one another such as by a rivet and pivot about their midpoints 22. They are also pivotably secured at a point 46 to a bracket 48 (shown in detail in FIG. 9) which is secured in channel 40 of each of the lower members 30. Consequently, when pressure is applied inwardly on each of the sides 12 and 14, the bars 18 slide upwardly causing the cross members 20 to fold and the seat 16 to collapse. Such inward pressure also causes the back 24 to collapse.

Figure 7:
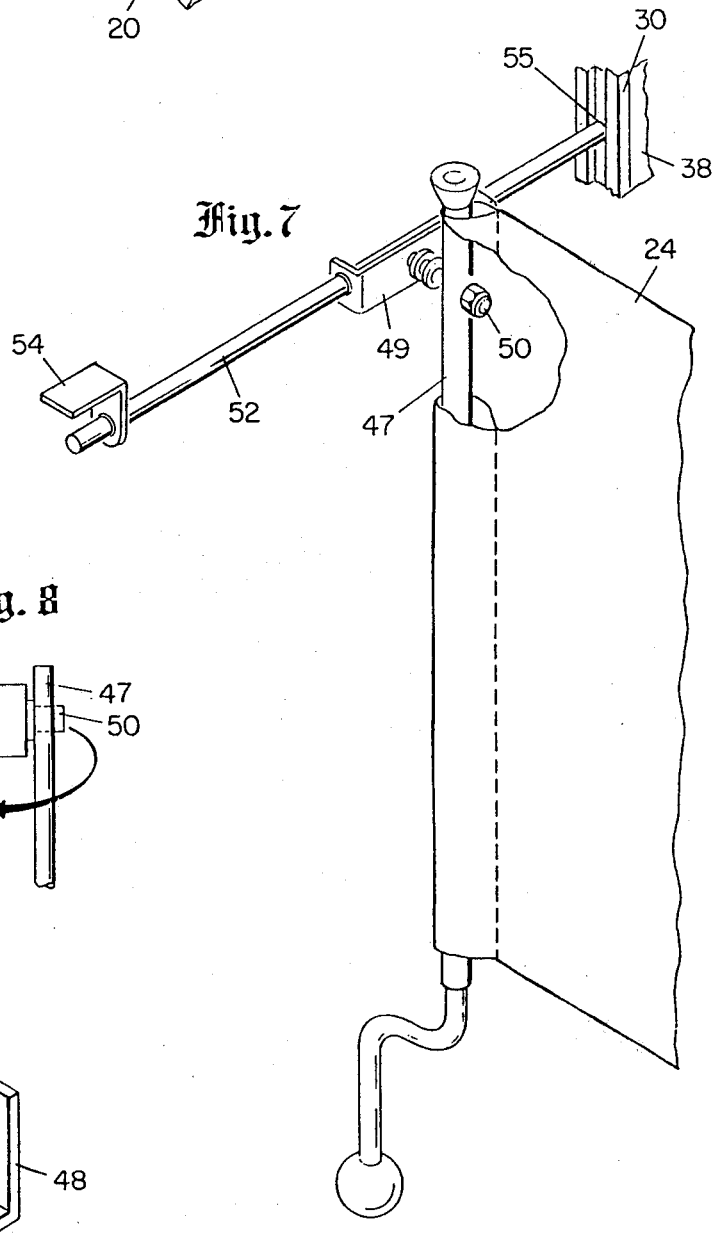
FIG. 7 is a perspective view illustrating the details of the pivotal connection of one side of the folding back to the rectangular sides of the chair shown in FIG. 1.

FIG. 7 is a perspective drawing showing details of the connection of the back 24 to the side members 12 and 14 by which such collapse is accomplished. The connection includes a pair of bars 47 each of which is secured to one of the opposite sides of the back 24. Each bar 47 may be constructed of a material such as aluminum which is light in weight but provides substantial rigidity. The bar 47 is secured to a sliding member 49 by a pivot 50. The sliding member 49 is bent at 90° at each end and has holes therein so that a circular bar 52 may slide therethrough. The bar 52 is fixed at its forward end to a right angle bracket 54 which is secured in channel 40 (such as by rivets) of each upper member 30 in which the sides 12 and 14 are constructed. Each bar 52 also passes through an aperture 55 in the rear one of vertical members 30 and is secured thereto.

Each of the bars 47 may be bent at its lower end to provide a hook which fits over and snaps around the member 19 supporting the seat 16. When the chair 10 is opened, each of the bars 47 depends in a generally downward position from the associated upper member 30 and is snapped over the member 19. The length of the bar 47 and the distance between the upper member 30 and the position of the seat 16 in the open position of the chair 10 are such that the seat back is inclined at an angle adapted to provide a comfortable position for an average person sitting in the chair.

Figure 8:
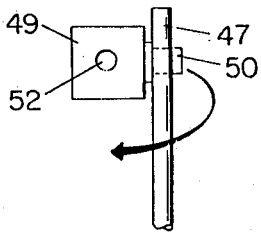
FIG. 8 is an end view of the connection shown in FIG. 7.
Figure 10:
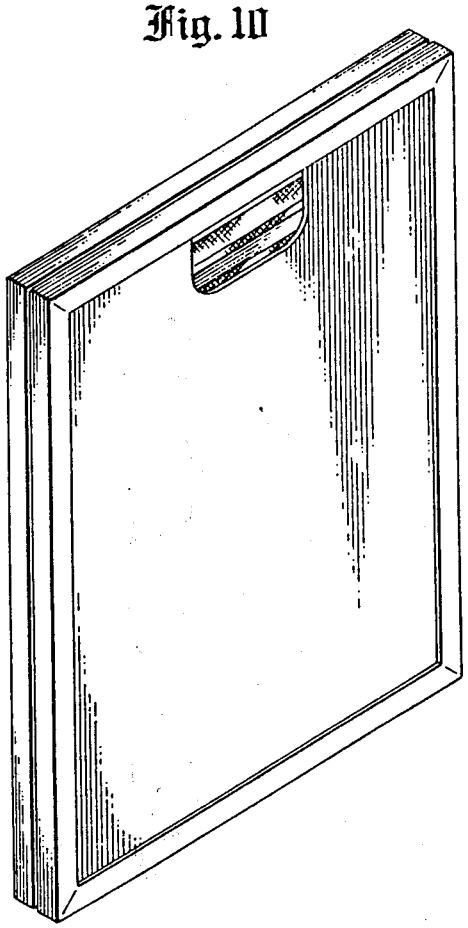
FIG. 10 is a perspective view of the chair of FIG. 1 shown in the folded condition.

When the chair 10 is to be folded, the lower ends of the bars 47 are removed from behind the members 19 and swung upwardly to a horizontal position. As the sides 12 and 14 come together, the sliding member 49 pivots at a right angle about the circular bar 52 as is shown in FIG. 8 thus causing the bar 47 to rotate to a position directly under the bar 52 and under the downward facing channel 40 of the upper member 30. This rotation allows the two sides 12 and 14 to collapse until the flexible covers 38 covering each of the members 30 forming the sides 12 and 14 touch one another. Consequently, the chair 10 folds into a very thin shape which is essentially rectangular in all directions. The openings 28 being positioned together in the closed position of the chair 10 provide a convenient handle and allow the chair 10 to be easily carried from place to place. Means (not shown) may be provided to secure the two sides together when closed. The very narrow width of the chair 10 when folded (see FIG. 10) allows it to be easily stacked with a number of like chairs without protruding legs and arms interfering with those of other chairs. The plastic protector surrounding the edges protects the entire chair in the folded state.

Especially important to the structure of the folding chair is the strength provided by the side panels 26 contained within the rectangle formed by the members 30. In one of the chairs known in the prior art has such strength been provided in such a light collapsible chair. Moreover, the same side panels 26 may be stylishly decorated so that such chairs will fit into the decor of a modern office or an apartment.

The ease with which the chair 10 of this invention may be constructed should be noted. As explained above, each of the members 30 is identical except in length and each may be cut at a 45° angle at each end. Prior to assembling the members 30 using right angle brackets 32, the brackets 48 holding the base of cross members 20, the brackets providing the stops 42, and those securing the circular bars 52 are positioned within the associated members 30. With these brackets in place, the members 30 may be secured to one another surrounding the side members 26. Cross members 20 are secured to the members 19 which receive the bars 18 to attach the seat 16; these are then inserted in the channels 40. The bars 47 may be secured to the brackets 54 by the circular members 50 connected to the sliding members 49, and the seat back 24 may be slipped over the two bars 47. Flexible coverings 38 may then be snapped into place over the elongated member 30 and the chair is completely assembled and ready to be used.

Such ease of manufacture is unusual with folding chairs which are normally constructed of many variously shaped parts offering a number of different types of operation in the construction.

While there has been shown and described a preferred embodiment, it is to be understood that various other adaptations and modifications may be made within the spirit and scope of the invention.

What is claimed is:

1. A chair having two rectangular side members having grooves therein, a folding seat the opposite sides of which slide vertically in said grooves, pivoting cross member supports for the seat, the upper ends of each support carrying the opposite sides of the seat and the lower ends of each being rotatably affixed to the side members, and a folding back comprising means rotatably connecting the folding back adjacent its opposite upper extremities to each of the rectangular side members, and means for securing the folding back at its opposite lower extremities to the seat at a predetermined angle.

2. A chair as in claim 1 in which each rectangular side member comprises a thin rectangular central member, and an essentially rectangular frame of elongated members surrounding and supporting the central member, the vertical ones of the elongated members having the grooves therein.

3. A chair as in claim 2 wherein the elongated members comprise metallic bars joined together by right angle brackets.

4. A chair as in claim 2 further comprising protective covers which snap over each of the elongated members.

5. A chair as in claim 1 further comprising means for causing the said means for rotatably connecting the folding back adjacent its opposite upper extremities to each of the side members to pivot into recesses within said rectangular side members whereby the side members may be collapsed into juxtaposition with one another.

6. A chair as in claim 3 wherein the elongated members include a central groove axially extending therein for containing fixtures for the seat and the back, a side groove axially extending therein for supporting the thin central rectangular side member, and a third groove therein for containing the right angle brackets to join the elongated members to one another.

7. A chair as in claim 1 further including a support for the folding back comprising a circular bar, means for affixing the bar to the chair, a generally U-shaped bracket having two apertures therein in opposite sides adapted to slidably receive the bar, and means for pivotably connecting the bracket to the folding back.

8. A chair as in claim 7 in which the means for pivotably connecting the bracket comprises a second bar adapted to fit through a pocket in the chair, and a pivot extending through the second bar and the bracket.

* * * * *